US007922140B2

(12) United States Patent
Carver

(10) Patent No.: US 7,922,140 B2
(45) Date of Patent: Apr. 12, 2011

(54) UNIVERSAL TRAVEL HOOK

(76) Inventor: Gretchen A. Carver, Dittmer, MO (US)

( * ) Notice: Subject to any disclaimer, the term of this patent is extended or adjusted under 35 U.S.C. 154(b) by 414 days.

(21) Appl. No.: 12/127,560

(22) Filed: May 27, 2008

(65) Prior Publication Data

US 2009/0294491 A1 Dec. 3, 2009

(51) Int. Cl.
*B42F 13/00* (2006.01)

(52) U.S. Cl. ..... 248/339; 248/303; 248/341; 248/914

(58) Field of Classification Search ..... 248/339, 248/340, 341, 914, 302, 303, 301, 307, 308; 223/85, 88
See application file for complete search history.

(56) References Cited

U.S. PATENT DOCUMENTS

| | | | | |
|---|---|---|---|---|
| 2,286,539 | A * | 6/1942 | Hagerstrom | 248/201 |
| 2,842,822 | A * | 7/1958 | Bennett | 24/370 |
| 3,907,118 | A | 9/1975 | Pelavin | |
| 4,858,867 | A | 8/1989 | King | |
| 5,254,065 | A | 10/1993 | Pollock | |
| 5,352,174 | A | 10/1994 | Mason et al. | |
| 5,556,369 | A | 9/1996 | Roberts | |
| 5,598,956 | A | 2/1997 | Schenberg | |
| 5,676,284 | A | 10/1997 | Schenberg | |
| 5,868,369 | A | 2/1999 | Montgomery | |
| 6,250,595 | B1 * | 6/2001 | Campbell | 248/211 |
| 6,273,376 | B1 | 8/2001 | Montgomery | |
| 6,854,610 | B2 | 2/2005 | Adams | |
| 7,757,996 | B2 * | 7/2010 | Jacobs | 248/64 |
| 2005/0087662 | A1 * | 4/2005 | Jacobs | 248/339 |

* cited by examiner

*Primary Examiner* — Ramon O Ramirez
(74) *Attorney, Agent, or Firm* — Husch Blackwell LLP

(57) ABSTRACT

A universal travel hook including first and second hook members and a connector member which pivotally connects the first and second hook members for rotation about an axis such that when in a closed configuration, the first hook member opens generally in the same direction as the second hook member in side-by-side relationship, and when in an open configuration, the first hook member opens generally in the opposite direction as the second hook member. In one embodiment, the connector is a split ring which pivotally connects to the hook members by extending through a through opening in the proximal end portion of each hook member. When in an open configuration, the first hook member is adapted for placement over a door or other object while the second hook projects outwardly therefrom and is adapted to receive and hold an article of clothing, a bag, or other object.

2 Claims, 2 Drawing Sheets

UNIVERSAL TRAVEL HOOK

BACKGROUND OF THE INVENTION

The present invention relates generally to a universal travel hook, and more particularly, to a universal travel hook with that has components adapted to be easily rotated relative to one another to transform between a compact travel state and an open state such that the hook can be used to hang clothing and other objects when other hooks are not readily available or usable. In one embodiment, the present invention relates to a hook assembly with two hook members which are rotationally connected to a key ring. When pivoted 180° about one axis from each other, the hook members open in opposite directions such that one hook member opens downwardly and can be hooked over a door or other object while the other hook member opens upwardly and projects out and is adapted to support other objects such as coats, backpacks, garment bags, carry-on luggage, or other items.

When faced with changing in public restrooms, hanging space is an important convenience, but it is not always an available option. Even when hooks are present, such public restroom hooks may not be sufficient in size or load capacity depending on the size and weight of the bags or clothing items that need to be hung. Additionally, hooks may also be desirable in hotel rooms, which rarely have sufficient counter space for all of one's things. Indeed, hooks are often desirable in a multitude of places—locker rooms, shower facilities, offices, diaper changing areas, barracks, airports and while camping. However, hooks are often unavailable in such places or are not well configured to support what is needed.

Portable hooks can help to alleviate this problem. However, many portable hook designs are not universal—for example, they may be suitable to fit over a door, but are not suitable to be used anywhere else. It is therefore desirable to create a compact hook apparatus which can be used on bathroom stall dividers, full frame doors, closet clothes bars, hinges or other structures which are strong enough to support backpacks, carry-on luggage, coats and/or clothing yet they are compact and multi-orientatable.

SUMMARY OF THE INVENTION

The present invention overcomes many of the shortcomings and limitations of the prior art hook devices and teaches the construction and operation of several embodiments of a universal travel hook. As will be discussed below, the hook members in the present embodiments are more versatile than hooks that can only be used in a single situation, and they are collapsible to a compact, low profile state suitable for travel.

In one embodiment, the present hook apparatus includes first and second generally U-shaped hook members each having a distal end portion and a proximal end portion. A connector is pivotally connected to the proximal end portions of the first and second hook members. In one embodiment, the connector is a split ring, such as is used for key rings, and the proximal end portion of each hook member includes a through hole or opening for receipt of and rotational attachment to the split ring or other connector. At least one of the hook members is articulated to rotate about the connector by preferably 180° of rotation from a closed configuration or travel state to an open configuration about at least one axis, though more or less rotation along one or more than one axis may be required depending on the configuration of the surroundings to which it is attached, such that the first hook member opens generally opposite the second hook member when so rotated. The first hook member opens generally in the same direction as the second hook member in a side-by-side relationship when in its closed, non-rotated, configuration.

BRIEF DESCRIPTION OF THE DRAWINGS

For a better understanding of the various embodiments of the present invention, reference may be made to the accompanying drawings, wherein like numbers refer to like or similar parts and/or construction.

DETAILED DESCRIPTION

Figure 1:
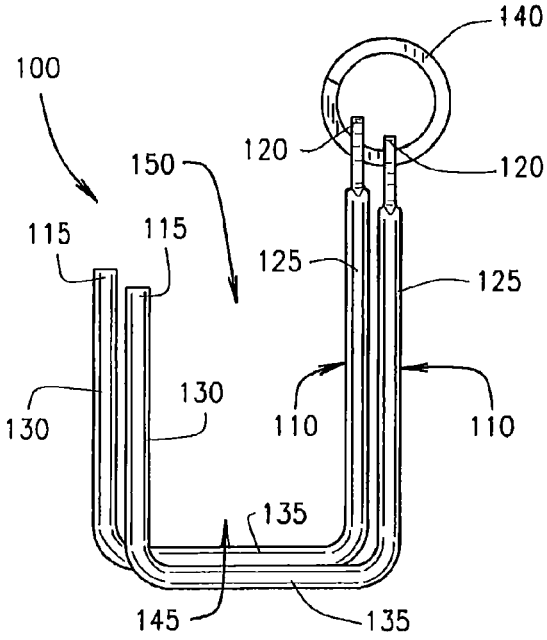
FIG. 1 is a front elevation view of one embodiment of a universal travel hook wherein the connector is a split ring and the universal hook assembly is in a closed configuration.
Figure 2:
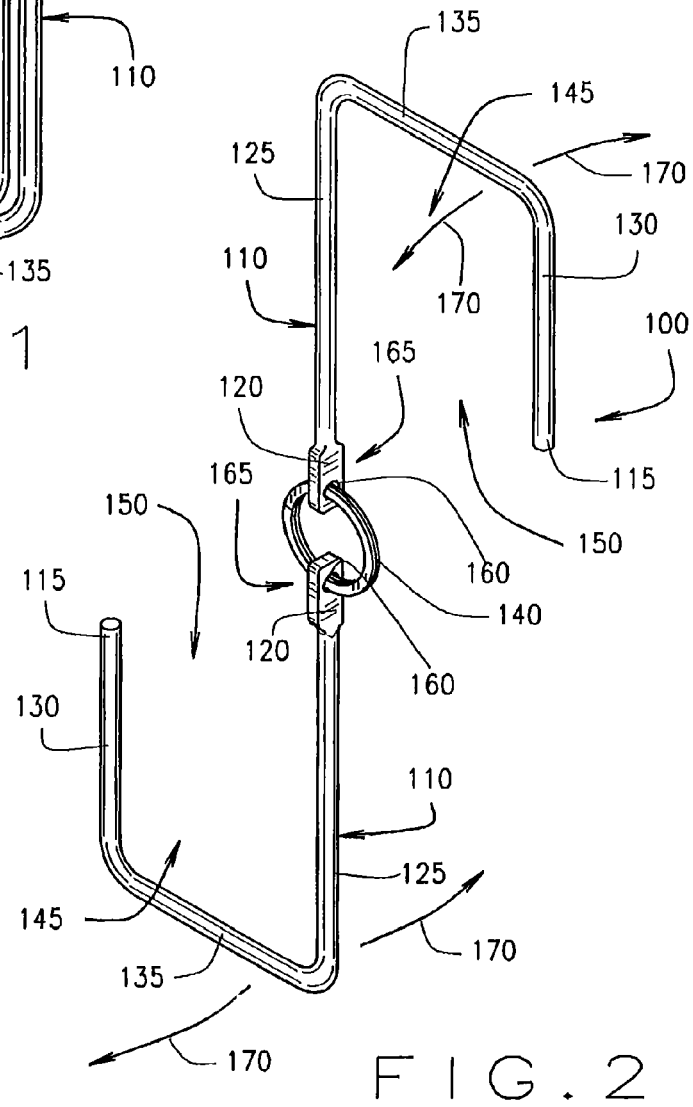
FIG. 2 is an isometric view of one embodiment of a universal travel hook wherein the connector is a split ring and at least one hook member is rotated to an open configuration.
Figure 3:
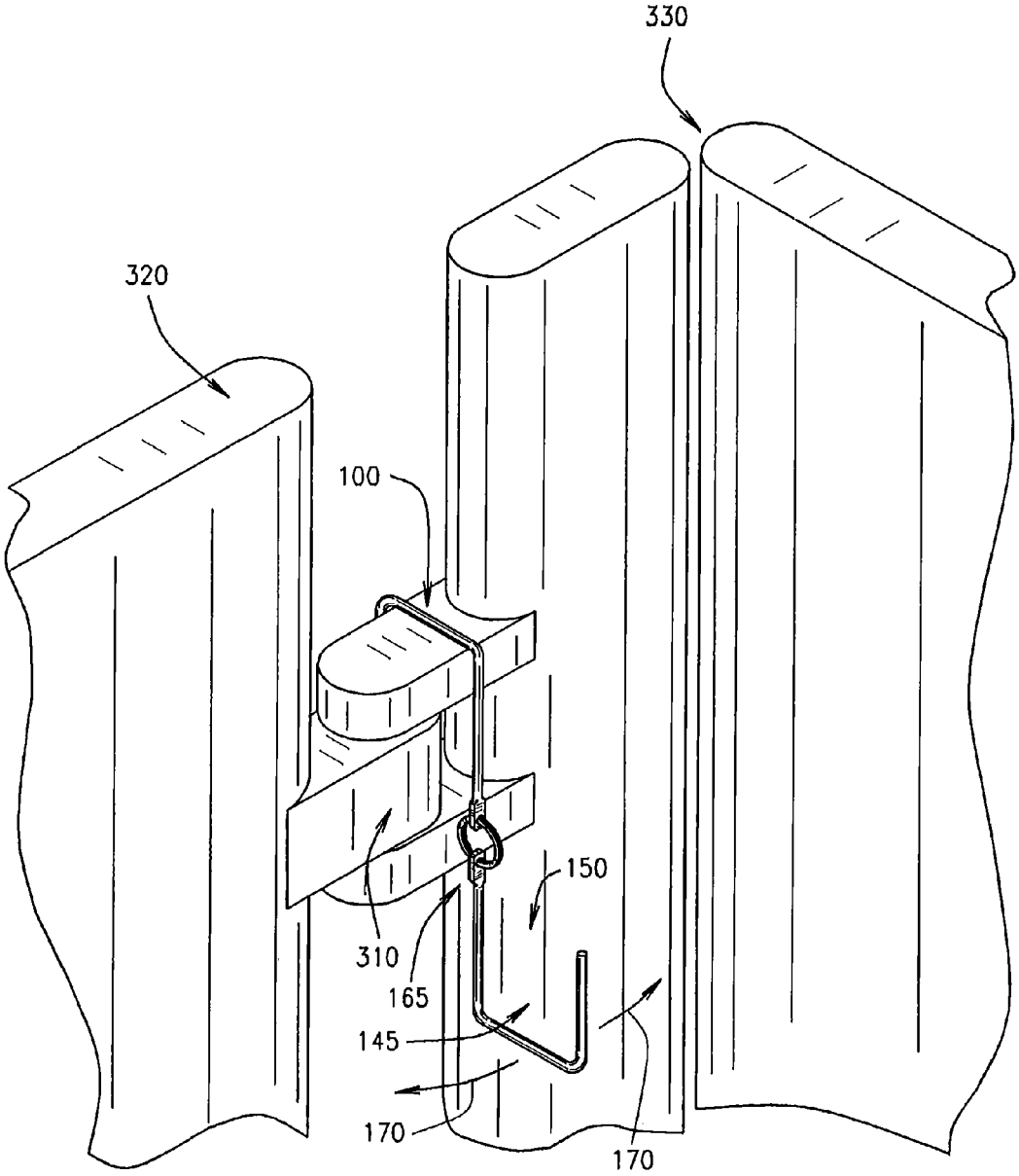
FIG. 3 is a isometric view of an embodiment of the universal travel hook in use with a bathroom stall door.

One embodiment of the present invention is illustrated in FIGS. 1-3. Referring to the drawings more particularly by reference numbers, the number 100 in FIGS. 1-3 identify one embodiment of a universal travel hook assembly constructed in accordance with the teachings of the present invention. Travel hook 100 includes first and second generally U-shaped hook members 110, each having a distal end portion 115 and a proximal end portion 120, and spaced apart legs 125 and 130 connected together by a bight 135. Travel hook 100 also includes a connector 140, which in FIGS. 1-3 is illustrated as a split ring. As best seen in FIG. 2, the connector 140 extends through a through hole or opening 160 in the proximal end portion 120 of each hook member 110, allowing each hook member 110 to independently rotate or revolve around the split ring connector 140 in three axes of movement. Though the connector 140 is illustrated as a split ring, it may also be a flexible cable or a pin which secures the first and second hook members together for rotational movement about the connector, or it may be any other connector which is known in the art which allows for rotation of at least one hook member 110 relative to the other. Additionally, the hook members 110 may be alternatively connected to connector 140 in any way known in the art which allows for rotation of at least one hook member 110 about the connector 140 and relative to the other hook member 110.

FIG. 1 shows travel hook 100 in a closed configuration which is compact and suitable for travel. The two hook members 110 open generally in the same direction in a side-by-side relationship when in this closed configuration. When in the closed configuration, an existing hook may be placed through the opening in the connector 140 or the connector may be placed on top of an existing hook such that both hook members 110 may be used as hooks. Additionally, both hook members 110 may be placed over an object, allowing an item with its own hook to be hung through the split ring connector 140.

FIGS. 2 and 3 show travel hook 100 in an open configuration. One hook member 110 is revolved or rotated around connector 140 by approximately 180° such that one hook member 110 opens generally opposite the other hook member 110. As best shown in FIG. 3, in this configuration, the mouth 150 and throat 145 of one hook member 110 can be placed over a door, a bathroom door, a stall divider, a hinge or other suitable object. FIG. 3 illustrates a travel hook 100 placed over a hinge 310 located between a bathroom stall door 320 and a bathroom stall divider 330. The other hook member 110 is illustrated as projecting outwardly thereby being available for hanging bags, clothing or other objects therefrom and such other hook member can be further rotated to accommodate obstructions, such as also being rotatable side-to-side about its hole 160 at a particular location along the periphery of the ring member such as location 165 as illustrated in FIGS. 2 and 3. Side-to-side rotation of the hook members 110 is illustrated by the arrows 170 in FIGS. 2 and 3. The universal travel hook 100 is preferably made of a metal strong enough to withstand large loads, though it may be made of any material which has sufficient strength to support such a load.

One or more embodiments of the present invention allow for the use and enjoyment of a universal travel hook assembly 100. Although only two hook members 110 are shown pivotally connected to connector 140 for rotation therearound, it is recognized and anticipated that any number of hook members 110 may be pivotally connected to connector 140. As such, the present universal travel hook 100 is adapted to be compact when in a closed configuration for travel and storage, and is adapted for hanging on a door, bathroom door, stall divider, hinge or other object to provide a hook when in an open configuration. Thus, a universal travel hook assembly 100 is suitable for many different situations, and can be easily reduced in size for travel.

As is evident from the foregoing description, certain aspects of the present invention are not limited by the particular details of the examples and drawings illustrated herein, and it is therefore contemplated that still other modifications, applications, or equivalents thereof, will occur to those skilled in the art.

Thus, there has been shown and described several embodiments of a novel hook assembly which is adaptable for use by travelers and users of all ages. Many changes, modifications, variations and other uses and applications of the present invention will, however, become apparent to those skilled in the art after considering this specification and the accompanying drawings. All such modifications, variations and other uses in applications which do not depart from the spirit and scope from the present invention are deemed to be covered by the present invention which is limited only by the claims which follow.

What is claimed is:

1. A hanging apparatus comprising:

first and second U-shaped hook members, said hook members each having a distal end portion and a proximal end portion and being movable between a closed travel configuration and an open configuration;

a ring member pivotally connected to said hook members adjacent the proximal end portions thereof, said ring member extending through a hole formed in the proximal end portion of each hook member, both of said first and second hook members being rotatable around the periphery of said ring member for at least 180° of rotation and being further rotatable in a side-to-side direction at any particular location along the periphery of said ring member such that the first hook member faces generally opposite the second hook member when said hook members are in their open configuration, and said first hook member facing generally the same direction as said second hook member when said hook members are in their closed travel configuration.

2. The hanging apparatus of claim 1 wherein said ring member includes a split ring member.

* * * * *